US005340063A

United States Patent [19]

Hsieh

[11] Patent Number: 5,340,063

[45] Date of Patent: Aug. 23, 1994

[54] FOLDING GOLF BAG STAND

[76] Inventor: Chi-Chung Hsieh, 6F-2, No. 67, Sung Chiang Road, Taipei, Taiwan

[21] Appl. No.: 64,237

[22] Filed: May 21, 1993

[51] Int. Cl.[5] ..... A63B 55/00

[52] U.S. Cl. ..... 248/96; 206/315.7; 248/171

[58] Field of Search ..... 248/96, 169, 171; 206/315.7, 315.3

[56] References Cited

U.S. PATENT DOCUMENTS 4,506,854 3/1985 Kim ..... 248/96
4,798,357 1/1989 Cho ..... 248/96
4,834,235 5/1989 Solheim et al. ..... 248/96 X
5,152,483 10/1992 Maeng ..... 248/96
5,154,377 10/1992 Suk ..... 248/96
5,209,350 5/1993 Maeng ..... 248/96 X

*Primary Examiner*—Ramon O. Ramirez
*Attorney, Agent, or Firm*—Morton J. Rosenberg; David I. Klein

[57] ABSTRACT

A folding golf bag stand including two legs pivotably fastened to a golf bag by a mount is provided. The folding golf bag stand includes a link frame having a top end pivotably connected to the legs and a bottom end coupled to a base plate hinged to the bottom of the golf bag. A spring supported between the legs, whereby the legs are forced by the link frame to extend outwards from the golf bag for supporting the golf bag in a sloping position as the golf bag is placed on the ground to depress the base plate.

4 Claims, 3 Drawing Sheets

FOLDING GOLF BAG STAND

BACKGROUND OF THE INVENTION

The present invention relates to a golf bag stand and more particularly to a folding golf bag stand fastened to a golf bag for supporting it in a sloping position.

A variety of golf bags are manufactured and used for carrying different golf clubs, golf balls, and umbrellas. A golf bag generally has a shoulder strap for carrying over the shoulder. When a full set of golf clubs are carried in a golf bag, the golf bag does not stand up as it is placed on the ground. Therefore, the golf bag must be carried over the shoulder all the time. When a golf bag is placed on the ground, it must be held with the hand to prevent it and the golf clubs therein from falling to the ground. Furthermore, when a golf bag is placed on the ground, it must be tiled to a suitable sloping position with the hand so that the user can easily find a specific number of club from others.

SUMMARY OF THE INVENTION

The present invention eliminates the aforesaid disadvantages. It is therefore the principal object of the present invention to provide a golf bag stand which is fastened to a golf bag for supporting it in a sloping position. It is another object of the present invention to provide a golf bag stand which can be collapsed to closely attach to the golf bag as the golf bag is not in use or carried on the shoulder. It is still another object of the present invention to provide a golf bag stand which automatically extends the legs thereof outwards to support the golf bag in a sloping position as the golf bag is placed on the ground. It is still another object of the present invention to provide a golf bag stand which is simple in structure and practical in use. It is still another object of the present invention to provide a golf bag stand which is safe in use. It is still another object of the present invention to provide a golf bag stand which can stably support the golf bag on a rugged place.

DETAILED DESCRIPTION OF THE PREFERRED EMBODIMENTS

Figure 1:
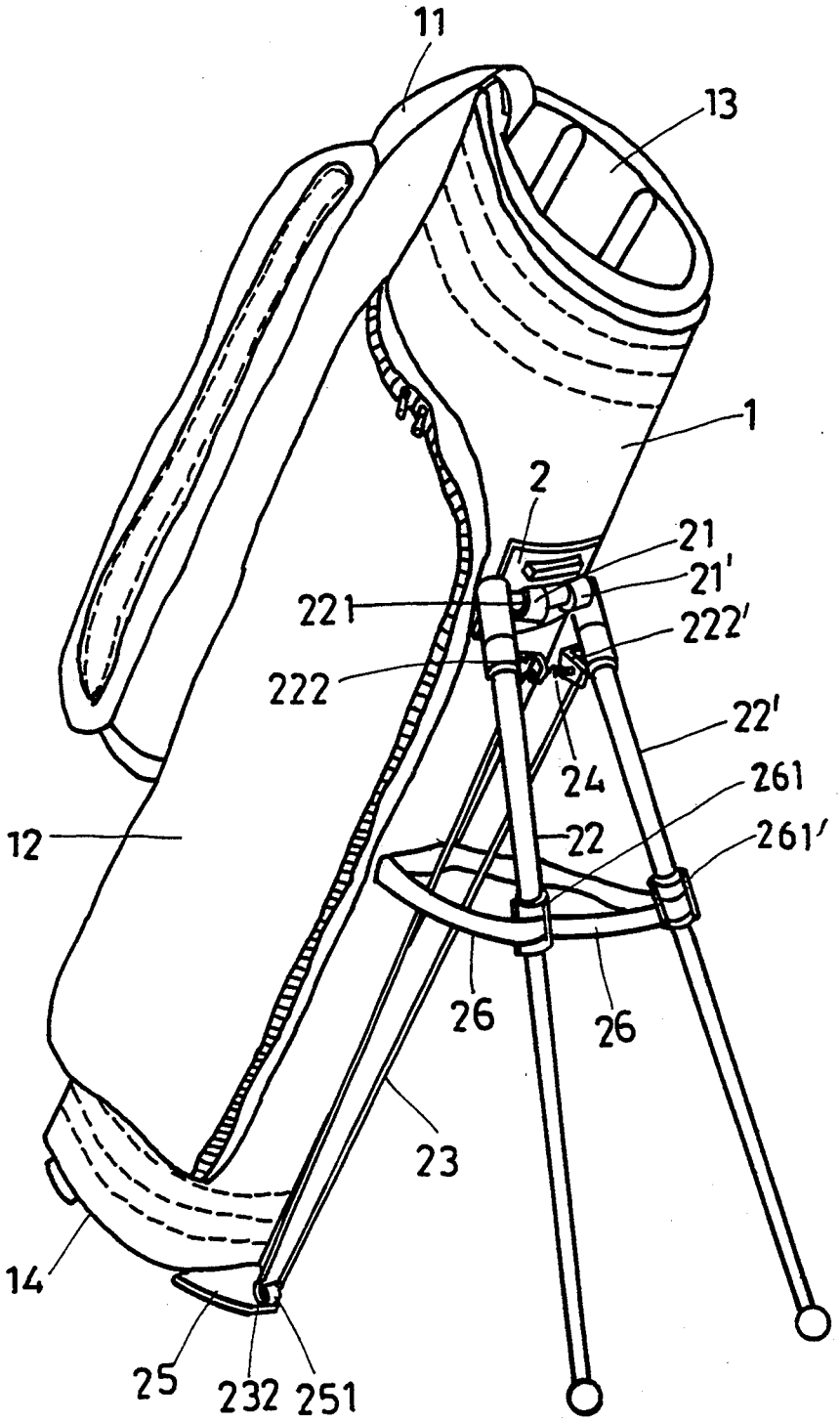
FIG. 1 is a perspective view of a folding golf bag stand of the present invention fastened to a golf bag to support it in a sloping position.
Figure 2:
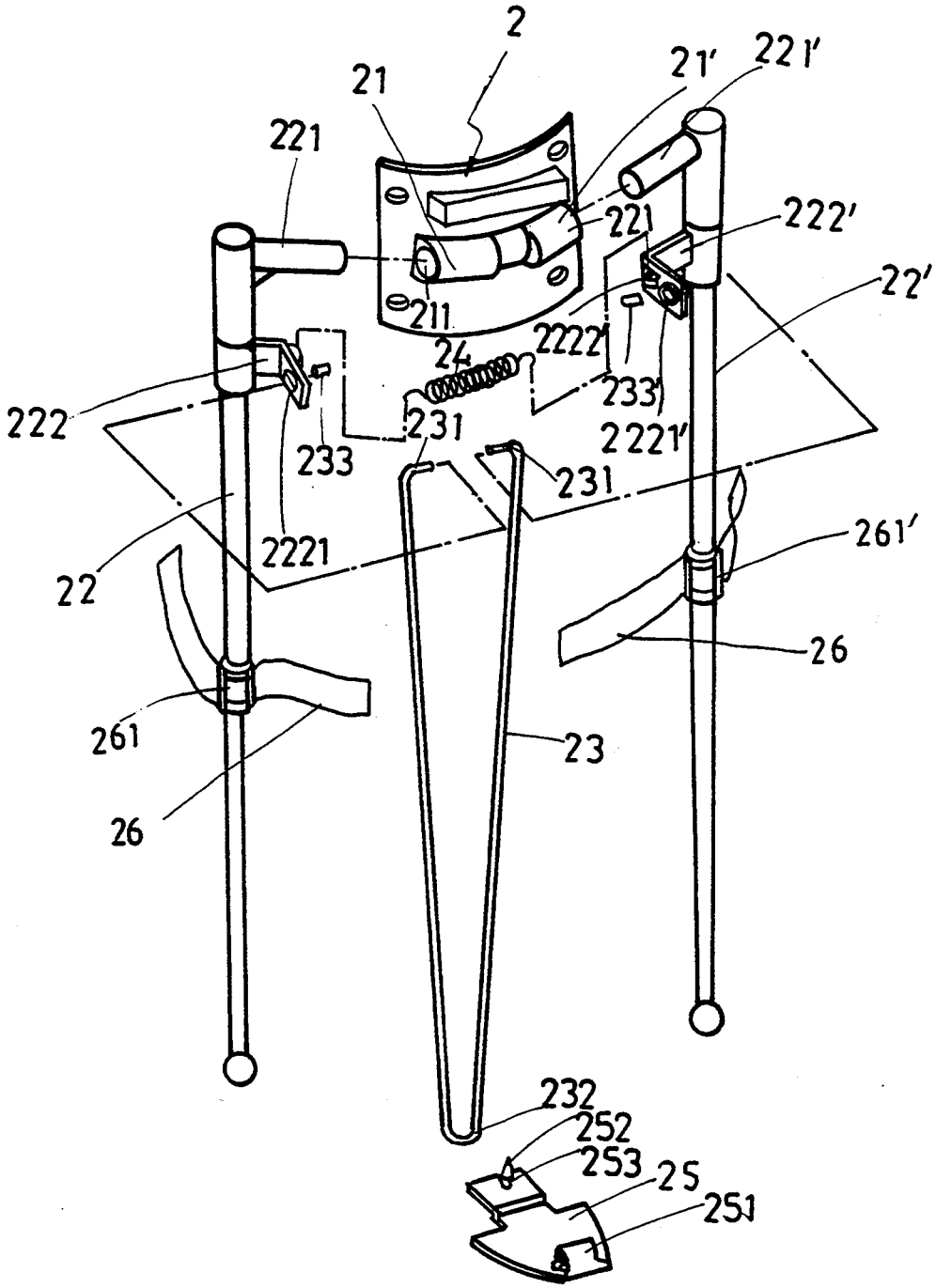
FIG. 2 is an exploded view of the folding golf bag stand.

Referring to FIGS. 1 and 2, a golf bag 1 comprises a ball pocket 12 for keeping golf balls, a bottom 14, a top opening 13 through which different golf clubs are inserted, a shoulder strap 11 for carrying over the shoulder. A mount 2 is fastened to the golf bag 1 on the outside at a suitable elevation. The mount 2 comprises two axle housings 21;21′ disposed in horizontal, each housing having an axle hole 211 or 211′ open at a respective outer end. There are two movable legs 22;22′, each leg having a pin 221 or 221′ perpendicularly disposed near the top and respectively fitted into the axle hole 211 or 211′ on either axle housing 21 or 21′. Therefore, the legs 22;22′ can be turned on the axle housings 21;21′ respectively. Each leg 22 or 22′ has a bearing frame 222 or 222′ with a through hole 2221 or 2221′ disposed below the pin 221 or 221′ for mounting a link frame 23. The link frame 23 has two opposing ends 231;231′ disposed at the same elevation and respectively inserted through the through holes 2221;2221′ on the bearing frames 222;222′ of the legs 22;22′ and locked by lock caps 233;233′. There is provided a coil spring 24 supported between the bearing frames 222;222′ of the legs 22;22′. The coil spring 24 has two opposite ends respectively fastened in a respective hole 2222 or 2222′ on either bearing frame 222 or 222′. The inward spring force of the coil spring 24 makes the legs 22;22′ and the link frame 23 retained together.

Figure 4:
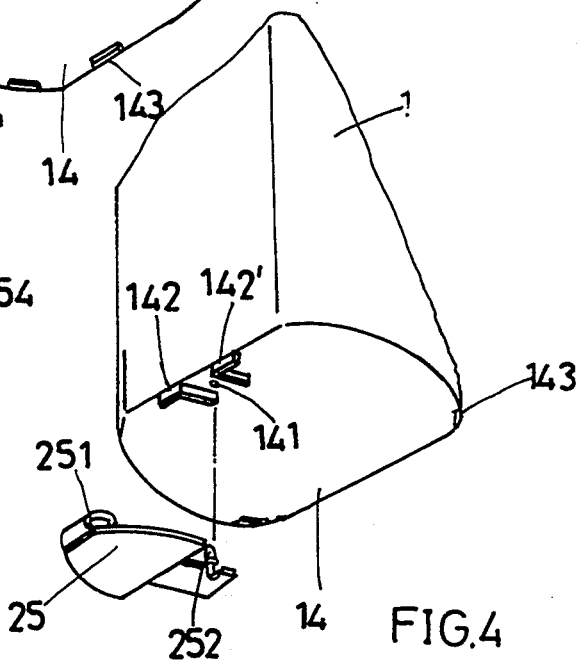
FIG. 4 is similar to FIG. 3 but showing an alternate form of the base plate.

Referring to FIG. 4 and FIGS. 1 and 2 again, the link frame 23 is made by bending an elongated rod into shape, having a middle portion 232 equally spaced from the two opposite ends 231; 231′ thereof and disposed at a different elevation. There is provided a base plate 25 hooked on the middle portion 232 of the link frame 23 by a hooked portion 251 thereof, having a lock bolt 252 peripherally covered with a flexible covering 253 and fitted into a hole 141 on the bottom 14 of the golf bag 1. Symmetrical bumper rods 142;142′ are fastened to the bottom 14 of the golf bag 1 around the hole 141 to retain the base plate 25 in position. Edge plates 143 are fastened to the bottom 14 of the golf bag 1 around the border for protection.

Referring to FIGS. 1 and 2 again, there is a locating strap 26 passed through loops 261;261′ on the legs 22;22′ and having two opposite ends respectively fastened to the golf bag 1. The arrangement of the locating strap 26 is to confine the included angle between the legs 22;22′ and the link frame 23 as the legs 22;22′ are extended outwards, so that the golf bag 12 can be supported on the link frame 23 in a proper sloping position.

Figure 3:
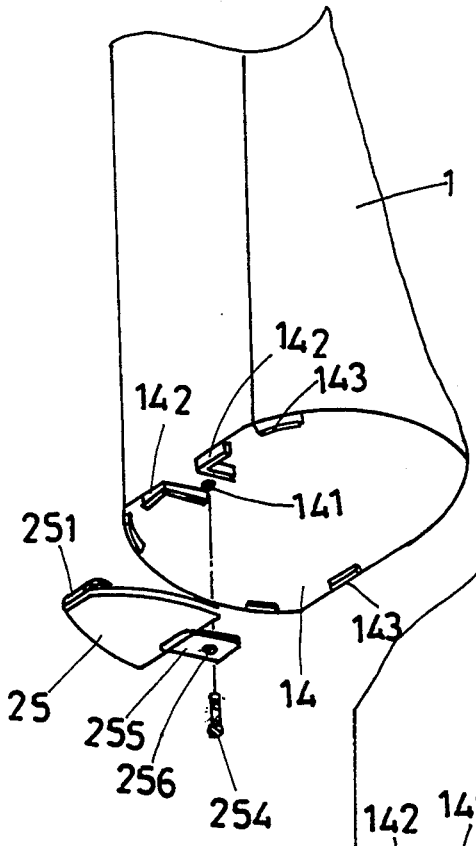
FIG. 3 is a dismantled view of the base plate and the bottom of the golf bag.

Referring to FIG. 3, therein illustrated is an alternate forth of the base plate 25. According to this alternate form, the base plate 25 has an extension plate 255 fitted into the gap between the bumper rods 142;142′ on the bottom 14 of the gold bag 1. The extension plate 255 has a through hole 256 fastened to the hole 141 on the bottom 14 of the golf bag 1 by a screw 254.

Figure 5:
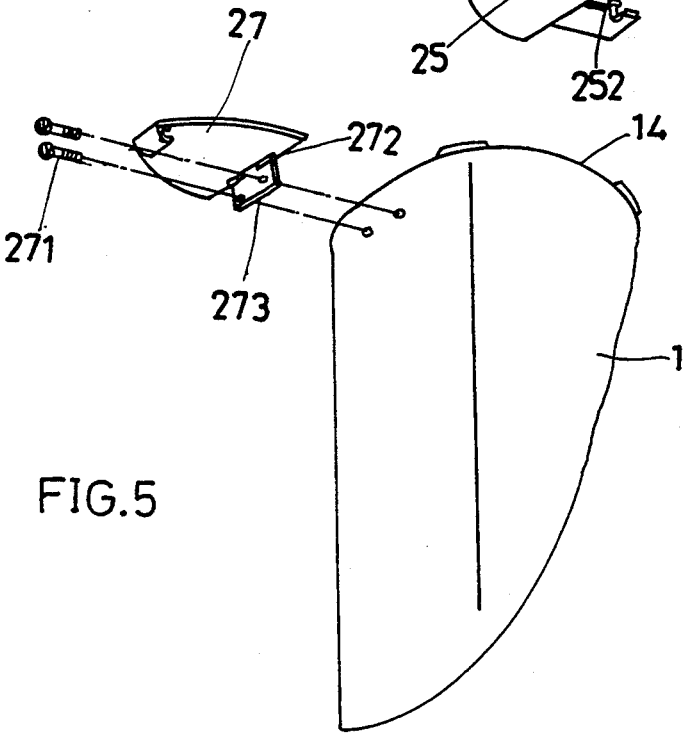
FIG. 5 is similar to FIG. 3 but showing another alternate form of the base plate.

Referring to FIG. 5, therein illustrated is another alternate form of the base plate 25. According to this alternate form, the base plate 25 is hinged with mounting plate 273 by a pivot pin 272. The mounting plate 273 may be fastened to the bottom 14 or periphery of the golf bag 1 by screws 271.

In either alternate form, the base plate 25 can be made from plastics to reduce its manufacturing cost.

While only few embodiments of the present invention have been shown and described, it will be understood that various modifications and changes could be made without departing from the spirit and scope of the invention. For example, a spring plate, elastic band or any suitable elastic element may be fastened between the legs 22;22′ to replace the coil spring 24.

What is claimed is:

1. A golf bag stand comprising:

a golf bag having bumper rods spaced on a bottom edge thereof;

a mount fastened to said golf bag on the outside at a higher elevation, said mount having two knuckles;

two legs respectively and pivotably connected to said knuckles, each leg comprising a pivot pin perpendicularly disposed near the respective topmost edge and respectively fastened to either knuckle, and a bearing frame connected to each other by spring means;

a link frame having a top end pivotably fastened to the bearing frame of each leg;

a base plate having one end coupled to a bottom end of said link frame and an opposite end fastened to said golf bag for supporting said golf bag on the ground; and a locating strap having two opposite ends respectively fastened to said golf bag to limit the angle of oscillation of said legs on said mount;

whereby said legs are forced by said link frame to extend outwards from said golf bag for supporting said golf bag in a sloping position as said golf bag is placed on the ground to depress said base plate.

2. The golf bag stand according to claim 1 wherein said spring means can be a coil spring or plate spring, or an elastic band, or an elastomer device.

3. The golf bag stand according to claim 1 wherein said base plate is retained between said bumper rods, comprising a hooked portion at one end hooked on said link frame, and a lock bolt at an opposite end covered with a flexible covering and fitted into a hole on said bottom edge of said golf bag.

4. The golf bag stand according to claim 1 wherein said base plate has one end hinged to said golf bag near said bottom edge and an opposite end hooked on said link frame.

* * * * *